US007840174B2

(12) United States Patent
Sanmiya et al.

(10) Patent No.: US 7,840,174 B2
(45) Date of Patent: Nov. 23, 2010

(54) BOOKMAKING APPARATUS AND IMAGE FORMING SYSTEM USING THE SAME

(75) Inventors: Shigeyuki Sanmiya, Yamanashi-ken (JP); Norihiro Ohno, Yamanashi-ken (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 1041 days.

(21) Appl. No.: 11/519,070

(22) Filed: Sep. 12, 2006

(65) Prior Publication Data

US 2007/0086876 A1 Apr. 19, 2007

(30) Foreign Application Priority Data

Sep. 13, 2005 (JP) ..... 2005-265935

(51) Int. Cl.
*B42C 9/00* (2006.01)

(52) U.S. Cl. ..... 399/408

(58) Field of Classification Search ..... 399/408, 399/388, 85; 412/901, 902; *B42C 9/00*
See application file for complete search history.

(56) References Cited

U.S. PATENT DOCUMENTS

2004/0141830 A1* 7/2004 Yoshie et al. ..... 412/1
2004/0194894 A1* 10/2004 Takagi et al. ..... 156/546
2005/0265764 A1* 12/2005 Iwai et al. ..... 399/408

FOREIGN PATENT DOCUMENTS

JP 2004-209869 7/2004
JP 2005254623 A * 9/2005

* cited by examiner

*Primary Examiner*—Judy Nguyen
*Assistant Examiner*—Jennifer Simmons
(74) *Attorney, Agent, or Firm*—Manabu Kanesaka

(57) ABSTRACT

A bookmaking apparatus executes sheet bundle stacking and image forming operations while melting adhesive at start up. A temperature control device controls a heating device to heat an adhesive in the container to a predetermined melting temperature when the apparatus power is turned on. A sheet conveyance device conveys and stack sheets sequentially from a conveyance path to the stacking tray while the temperature control device melts the adhesive.

8 Claims, 8 Drawing Sheets

BOOKMAKING APPARATUS AND IMAGE FORMING SYSTEM USING THE SAME

BACKGROUND OF THE INVENTION AND RELATED ART STATEMENT

The present invention relates to bookmaking apparatuses that apply adhesive to side edges of a series of sheets aligned to form a bundle and bind them together with a cover sheet, and image forming systems that sequentially stacks sheets printed by an image forming apparatus that uses a bookmaking apparatus, applies adhesive to a side edge of sheets, and binds the sheets to a cover sheet to form a booklet. More particularly, the present invention relates to a bookmaking apparatus that effectively starts up from a cold start, or when restarting after the apparatus has been stopped.

Generally, these types of apparatuses are widely used as end devices of image forming apparatuses such as printers or copiers, and as bookmaking systems that bind a side of sheets formed with images to a cover sheet after stacking the sheets in page order and forming a bundle, and dispensing adhesive to that side. A variety of apparatus have been proposed that print predetermined information and at the same time automatically bind sheets, as an on-demand printing system, particularly recently in electronic publication.

As an example of such a system, Japanese Patent Publication No. 2004-209869 discloses one that automatically finishes a booklet of sheets output from an image forming apparatus as the latter system apparatus. According to that document, sheets output from an image forming apparatus are received from that discharge outlet and guided to the discharge path, then stacked in a tray provided at a downstream side of the discharge path. The sheet bundle stacked on the tray in a substantially horizontal posture are turned 90 degrees and guided to an adhesive application position in a vertical posture for the application of adhesive. An apparatus that folds and binds a sheet bundle applied with adhesive together with a cover sheet supplied from an inserter provided at a discharge path to bind them is disclosed.

For example, in the system disclosed by Japanese Patent Publication No. 2004-209869 to apply adhesive to a sheet bundle held in a vertical posture by gripping means, a container holding adhesive is provided, and a roller arranged in the container, covered with adhesive travels along the side edge of the sheets to apply adhesive to the bottom edge of the sheets. Thermo-fusion (or hot melt) adhesive is used as the adhesive. This type of adhesive is in a solid form until it is placed in the container, and is easy to handle. After it is placed in the container, it melts into a liquid form for application to the sheet bundle. After application, it hardens and becomes fixed to the sheet bundle. In apparatus that use this kind of thermo-fusion adhesive, the apparatus is operable after the adhesive in the container is heated by heating means (such as a heater embedded in the container that stores adhesive) to a predetermined melting temperature.

In a bookmaking apparatus that uses thermo-fusion adhesive, a warming-up operation may be performed while reheating adhesive that is hardened in the container to a predetermined position temperature, such as when the apparatus is started or restarted after trouble such as a paper jam has occurred. The purpose of such a warming-up operation, i.e., receiving sheets in a stacking tray, is to allow plenty of time for the adhesive in the container to completely reach a predetermined melting temperature so that the degree of adhesive melting does not vary according to the ambient temperature of the apparatus, the amount of adhesive in the container, or the degree of solidification of the adhesive.

Therefore, the execution of operations such as the setting of operating modes, printing processes and the stacking of sheets into bundles is possible after the apparatus has passed a warming up time. For example, in a system that links a bookmaking apparatus to a discharge outlet of an image forming apparatus, the remaining adhesive in the container is melted at the same time as the image forming unit is initializing and the apparatus detects any sheets remaining in the sheet conveyance path, and after everything is prepared for operation, operations are executed in the order of printing, stacking sheets in a bundle, and gripping and conveying the sheet bundle to the adhesive application position. For that reason, if time is required to melt the adhesive in the container, the sheet stacking unit and the image forming unit at an upstream side of the adhesive application position are placed at an idling state. As time is required in melting remaining adhesive, productivity of the system is an issue.

An object of the present is to provide a bookmaking apparatus that can improve the operating rate of the apparatus as a system by executing upstream sheet bundle stacking and image forming operations while melting adhesive when starting up the apparatus.

SUMMARY OF THE INVENTION

A first aspect of the present invention includes a sheet conveyance path for sequentially conveying printed sheets; sheet conveyance means arranged on the sheet conveyance path for sequentially conveying sheets; stacking tray means for stacking sheets from the sheet conveyance means in a bundle; sheet holding means for conveying and holding the sheet bundle from the stacking tray means at a predetermined adhesive application position; and adhesive application means for applying adhesive to a sheet bundle held by the sheet holding means.

The adhesive application means comprises a container that includes heating means for melting thermo-fusion type adhesive, an applicator member arranged in the container for applying adhesive to an edge of a sheet bundle, and temperature control means for maintaining the adhesive in the container at a predetermined temperature with the heating means.

The temperature control means controls the heating means so that the adhesive in the container reaches a predetermined melting temperature. The sheet conveyance means operates to convey and stack sheets sequentially from the conveyance path to the stacking tray means while the temperature control means melts the adhesive.

In one aspect, unlike related art that must wait a warming up time for adhesive stored in a container to melt and reach a predetermined temperature before forming images and stacked sheet bundles, the current invention improves system processing efficiency because executions of these processes are performed while adhesive is being melted.

A second aspect of the present invention controls the sheet holding means in order to convey a stacked sheet bundle from the stacking tray means and to hold the sheet bundle at the predetermined adhesive application position while the temperature control means controls the heating means in order to melt the adhesive in the container, such as while power is first applied to the apparatus. This further improves system efficiency.

A third aspect of the present invention includes a control means for controlling the sheet conveyance means. The sheet conveyance control means controls a conveyance of a subsequent sheet from the sheet conveyance path to the stacking tray means after the sheet holding means conveys and holds the sheet bundle at the predetermined adhesive application position while controlling the heating means. Stacking sheets takes time, and this aspect of the apparatus makes it possible to stack a series of subsequent sheets after a first series of sheets is stacked, thereby improving processing efficiency.

A fourth aspect of the present invention provides a cover sheet conveyance path at a downstream side of the adhesive application position. Cover sheet conveyance means are arranged in the conveyance path to convey a cover sheet from a predetermined conveyance position and the cover sheet conveyance means is controlled to convey and set a cover sheet to a predetermined position while the temperature control means controls the heating means to melt adhesive in the container while power is being supplied to the apparatus. The cover sheet conveyance means sets the cover sheet at the predetermined position prior to dispensing adhesive to the sheet bundle, so even if conveyance trouble occurs with the cover sheet, adhesive is not dispensed to the sheet bundle, eliminating the problem of adhesive solidifying while the problem is being remedied.

A fifth aspect of the present invention is to provide an image forming apparatus for forming images on sheets; a sheet conveyance path for sequentially conveying printed sheets from the image forming apparatus; sheet conveyance means arranged in the sheet conveyance path for sequentially conveying sheets; stacking tray means for stacking sheets from the sheet conveyance means in a bundle; sheet holding means for conveying and holding the sheet bundle from the stacking tray means at a predetermined adhesive application position; and adhesive application means for applying adhesive to a sheet bundle held by the sheet holding means.

The adhesive application means comprises a container including heating means for melting thermo-fusion type adhesive, an applicator member arranged in the container for applying adhesive to an edge of a sheet bundle, and temperature control means for maintaining the adhesive in the container at a predetermined temperature with the heating means.

The temperature control means controls the heating means so that the adhesive in the container reaches a predetermined melting temperature, while power is being supplied to the apparatus. The sheet conveyance means are provided control means for conveying printed sheets from the image forming apparatus sequentially from the conveyance path to the stacking tray means while the temperature control means melts the adhesive. Processing efficiency is improved by stacking sheets into bundles after forming images, while conducting the time consuming process of melting adhesive.

The present invention comprises a container having heating means for melting thermo-fusion adhesive. The present invention conveys sheets sequentially from the conveyance path to a downstream stacking tray while temperature control means of the heating means controls the heating means so that the adhesive in the container reaches a predetermined temperature. At the same time, the control means of the sheet conveyance means, arranged in the conveyance path, melts the adhesive using the heating means, in order that the conveyance of sheets and stacking of sheets into bundles can be executed in parallel at an upstream side during the time it takes to melt the adhesive. Therefore, the overall processing efficiency of the apparatus is improved.

Furthermore, the stacking of sheet bundles from the image forming apparatus is executed first for a system that links an image forming apparatus and bookmaking apparatus, thereby executing the adhesive application process quickly after the adhesive in the container has melted. This improves apparatus productivity.

BRIEF DESCRIPTION OF THE DRAWINGS

FIGS. 4A and 4B are side views of adhesive application means according to the apparatus of FIG. 1, wherein FIG. 4A illustrates container movement and FIG. 4B illustrates heating elements installed on the container.

DETAILED DESCRIPTION OF PREFERRED EMBODIMENTS

Figure 1:
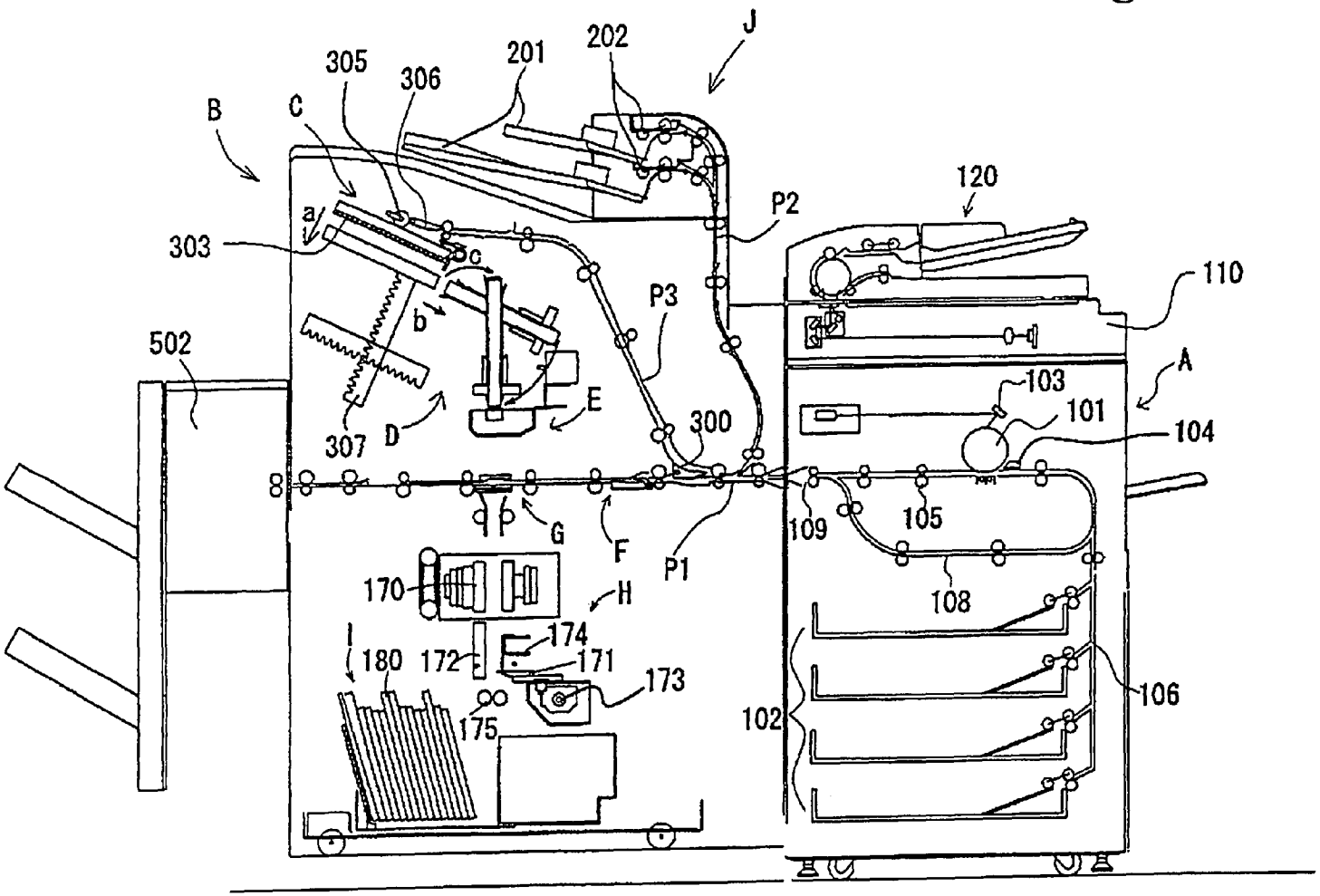
FIG. 1 is a side view of the overall structure of the image forming system according to the present invention.
Figure 2:
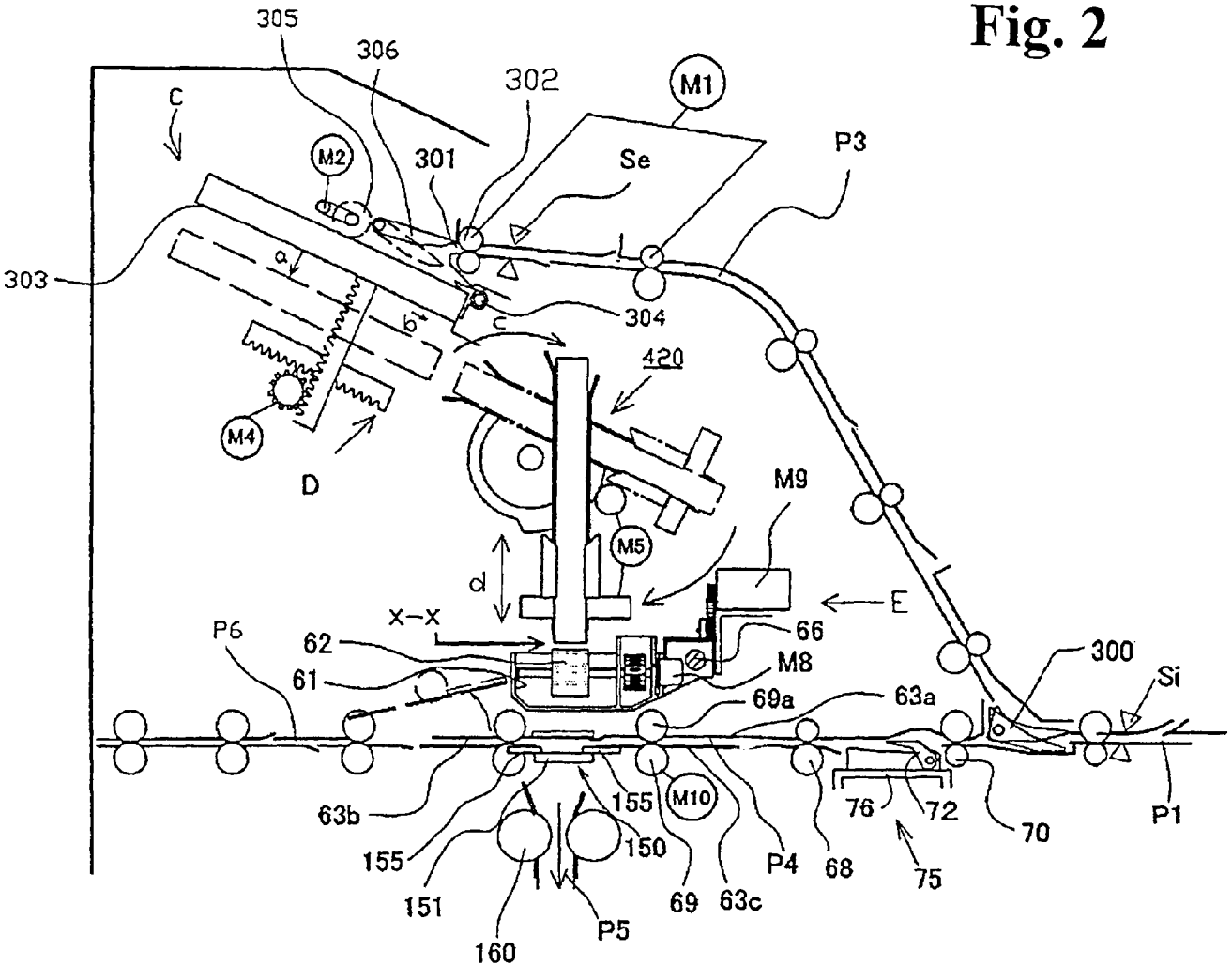
FIG. 2 is a detailed view of the bookmaking portion of the apparatus of FIG. 1.

A bookmaking apparatus and an image forming system that includes the same will be explained below with reference to the drawings provided. FIG. 1 is a side view of an image forming system. FIG. 2 is a detailed side view of the image forming system according to FIG. 1. The image forming system shown in FIG. 1 comprises an image forming apparatus A that sequential prints images to sheets; a bookmaking apparatus B that stacks a series of sheets from the image forming apparatus A in a bundle and binds them to a cover sheet to form a booklet; and an inserter J that supplies cover sheets to the bookmaking apparatus B.

Image Forming Apparatus

A series of documents from a system such as a computer or word processor is printed to surfaces of sheets and is discharged from a discharge outlet 109. Any printing means, such as a laser printer or ink jet printer may be employed. Non-limiting, the printing means does not have any particular feature or characteristic. Therefore, any known printer configuration or image forming apparatus configuration may be easily applied in conjunction with the present invention.

An image forming apparatus A may comprise a printing drum 101 such as an electrostatic drum; a sheet feeder cassette 102 that feeds sheets to the printing drum 101; a print head 103, such as a laser, that forms an image on the printing drum 101; a developer 104 and a fixer 105. Sheets are feed from the sheet feeder cassette 102 to a sheet feeding path 106. The printing drum 101 is arranged on the sheet feeding path 106. A latent image is formed on the printing drum 101 and toner ink is affixed thereto by the developer 104. The toner image formed on the printing drum 101 is transferred to a surface of the sheet and fixed thereto by the fixer 105. The sheet is then discharged from the discharge outlet 109.

In addition, the image forming apparatus A may comprise a turn-over path 108 that includes a duplex path for printing to a back surface of a sheet by turning over the image printed sheet, from front to back and guiding it to the printing drum 101 again.

FIG. 1 shows an image forming apparatus 110 comprising an ordinary scanner apparatus, having a platen (made of glass or other transparent material) for setting the original; a reciprocating scanning carriage that travels under and along the length of the platen; and photoelectric conversion elements. The original feeding apparatus 120 automatically supplies originals, set in a stacker by an operator, to the platen top. The original feeding apparatus 120 sequentially supplies the originals one at a time to a reading unit where the original image is photo-electrically converted and supplied to a data storage unit on the print head 103.

An external device such as a computer or word processor containing the original in electronic format may be connected to the data storage unit. Although the image forming apparatus A shown in the drawings is a laser printer, the invention is by no means limited thereto and may employ any type of printing method such as an ink jet printer, silk screen printing or offset printing.

Bookmaking Apparatus

Still referring to FIG. 1, the bookmaking apparatus B comprises a stacking tray unit C that sequentially stacks sheets in up and down directions in page order output from the discharge outlet 109 of the image forming apparatus A. Furthermore, the bookmaking apparatus B aligns sheets into a bundle and comprises a bundle conveyance unit D that conveys and sets a sheet bundle, stacked and aligned, to an adhesive application position of a next process. An adhesive application unit E applies adhesive to one edge of the sheet bundle and a cover sheet conveyance unit F is configured at a downstream side of the adhesive application position to feed and set a cover sheet at a binding position where a binding unit G joins the cover sheet and the sheet bundle applied with adhesive. Bookmaking apparatus B further includes a cutting unit H that cuts the edge of the bound sheet bundle at a predetermined amount and a storage stacker unit I that stores a sheet bundle that is finished into a booklet. The configuration of each of the above units C through H is described below.

Stacking Tray Unit

As shown in FIG. 1, a sheet conveyance path P1 is linked to the discharge outlet 109 of the image forming apparatus A. The sheet conveyance path P1 traverses substantially the center of the apparatus B and is arranged in a substantially horizontally direction. A sheet feeding path P2 of the inserter J described above is connected to an inlet edge of the sheet conveyance path P1. A discharge path P3 is arranged to branch off and guide a sheet to an upper direction from the sheet conveyance path P1 via a path switching piece 300. Discharge rollers 302 (sheet conveyance means) and a sheet sensor Se are arranged at a discharge outlet 301. A stacking tray 303 forming a step is obliquely arranged at a downstream side of the discharge outlet 301 in a substantially horizontal direction in the drawings.

A trailing edge aligning member 304 that aligns a trailing edge (in the direction of sheet conveyance) of the sheet, an aligning roller 305, and sheet guide 306 are arranged at the stacking tray 303. The aligning roller 305 is linked to a drive motor that is capable of both forward and reverse drives. When the sheet is discharged from the discharge outlet, this motor rotates in a discharge direction (a clockwise direction of FIG. 1). After the trailing edge of the sheet advances into the tray, the motor rotates in an opposite direction (a counterclockwise direction of FIG. 1) to engage and align the trailing edge of the sheet against a trailing edge aligning member 304. A sheet guide 306 is linked to drive means such as an operating solenoid, not shown, to guide a sheet from the discharge outlet, as shown in FIG. 1, to the top of the tray and to swing freely to guide a sheet along the tray 303 to the aligning member after the sheet is conveyed.

Aligning means that align left and right sides in the width direction of a sheet, or align a sheet at a center reference are provided on the stacking tray 303. The aligning means, not shown, are arranged to move a pair of aligning plates (for example on the left and right sides) in a width direction over a tray. At least one of the aligning plates is reciprocatingly moved, by a drive motor, to align sheets at a predetermined reference position. Of particular note, the stacking tray 303 is movably supported on the apparatus frame to move in up and down directions of FIG. 1. The stacked sheets are thus moved in the direction of the arrow a in the drawing, and then moved in the direction of the arrow b to be conveyed to the gripping conveyance means 420 (hereinafter referred to as sheet holding means). Next, the stacking tray 303 engages a guide rail, for example, on an apparatus frame to freely rise and lower between a stacking position for stacking sheets, and a lowered position at a bottom side a predetermined amount. A rack 307 and pinion is operable to raise and lower the tray 303 by a drive motor between the stacking position and the lowered position. The pinion is linked to the drive motor and the rack 307 that engages the pinion is fastened to the tray.

Bundle Conveyance Unit

The bundle conveyance unit D is configured to convey the sheet bundle after moving the tray 303 from the stacking position to a lowered position a predetermined distance therebelow. The bundle conveyance unit D comprises gripping conveyance means 420. The sheet bundle is received from the stacking tray 303 in a substantially horizontal posture and is turned 90 degrees to be substantially vertically oriented and is sent to the adhesive application position (FIG. 2 X-X).

Figure 3:
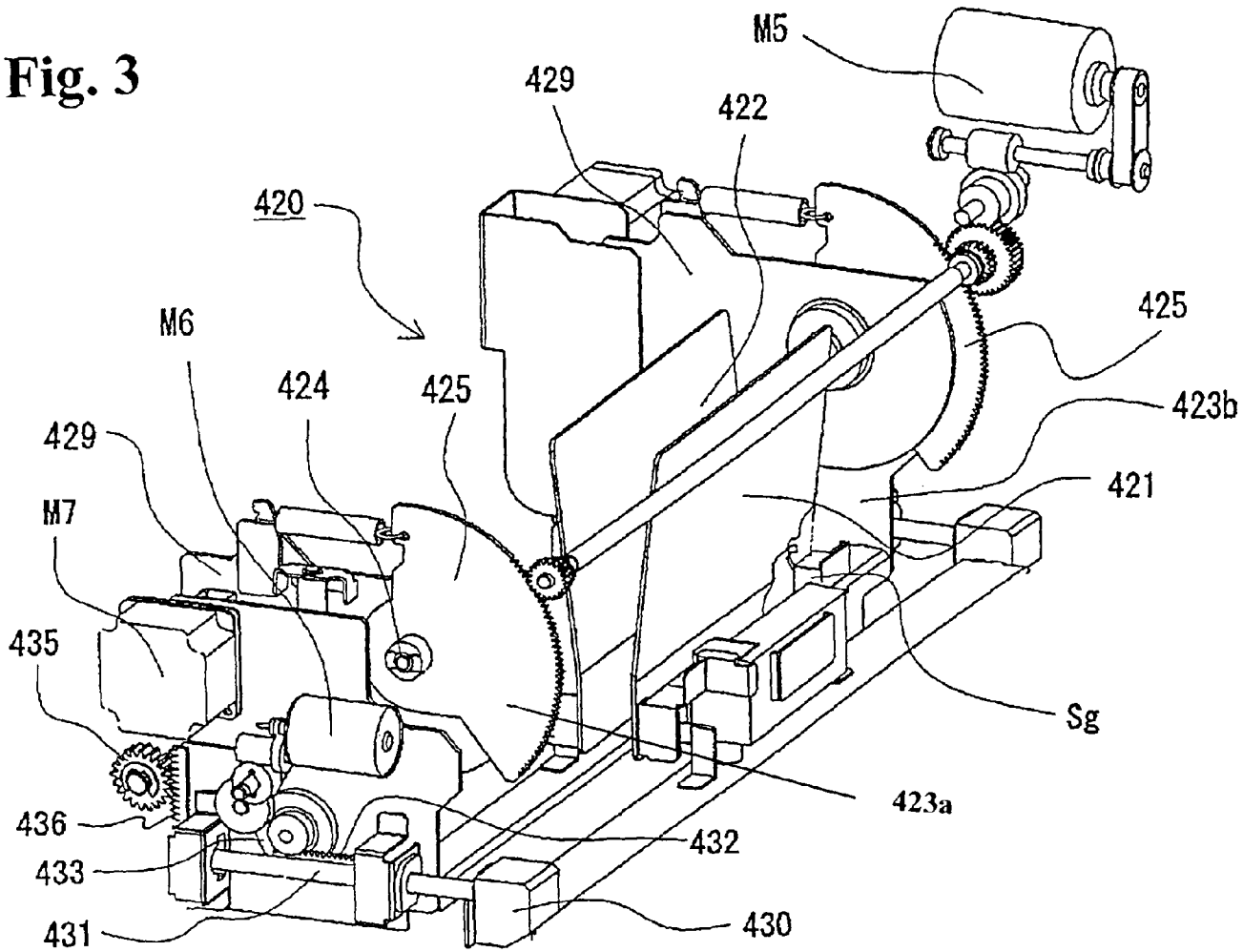
FIG. 3 is a perspective view of sheet holding means (gripping conveyance means) of the apparatus of FIG. 1.

As shown in FIG. 3, gripping conveyance means 420 is configured by embedding clampers 421 and 422 into a unit frame that is rotatably supported on a shaft 424 on the apparatus frame. A fan-shaped gear 425 fixedly mounted to the unit frame 429 is rotated a predetermined amount around shaft 424 by a turning motor M5 mounted on the apparatus frame. A pair of clampers on the unit frame 429 is composed of a movable clamper 421 and a fixed clamper 422 for gripping a sheet bundle fed from the stacking tray 303.

Right and left side frames 423*a* and 423*b* are risibly mounted to the frame 429 by a guide rail, not shown. The fixed clamper 422 is fastened to the right and left side frames 423*a* and 423*b*. The movable clamper 421 is fastened to the rod 431 at an attachment point 430. Rack 432 is provided on the rod 431, and a pinion 433 linked to a drive motor M6 meshes with the rack 432. Therefore, by driving the drive motor M6, the movable clamper 421 moves in the left and right directions of FIG. 3. The side frames 423 with the mounted clampers move a rack 436 mounted to a side frame in an up and down direction in FIG. 3, via a pinion 435 using a rising and lowering motor M7 mounted to the unit frame 429. The type of rising and lowering motor M7 is non-limiting, and may, for example, comprise a stepping motor. The positions of the fixed clamper 422 and movable clamper 421, supported by the left and right side frames 423*a* and 423*b*, are controlled in up and down directions of FIG. 2 (see arrow d) by controlling a supply of electrical pulses to the motor M7.

Therefore, the movable clamper 421 and the fixed clamper 422 sandwich and release a sheet bundle therebetween by operation of the drive motor M6. Both clampers reciprocatingly move in directions of arrow d of FIG. 2 by the rising and lowering motor M7. The gripping conveyance means 420, composed of both clampers, configure a sheet holding means that grip and convey sheets to an adhesive application position where adhesive is applied to the sheet bundle. A gripping sensor Sg is provided at the movable clamper 421 for detecting the status of contact with the sheet bundle. A detecting sensor Sa (not shown) is provided at the rod 431 of the movable clamper 421 for detecting sheet bundle thickness. The sheet bundle thickness sensor Sa detects a gap between the fixed clamper 422 and the movable clamper 421 using, for example, a slider sensor.

It is possible to detect sheet bundle thickness from the status of the sheet bundle thickness sensor Sa (for example a resistance measured in ohms) using the signal when the gripping sensor Sg turns ON by touching the sheets. Thickness detection means detect the thickness of a sheet bundle stacked on the stacking tray 303. (1) The gap between the adhesive applicator roll, described below, and the sheet bundle is set to correspond to the thickness of the sheet bundle. (2) The setting position of the cover sheet is adjusted to correspond to the amount of feed for the cover sheet and the thickness of the sheet bundle, and the sheet bundle is set to match the center of the cover sheet. (3) The starting position of the sheet cutting blade is adjusted to correspond to the sheet bundle thickness and is used in a subsequent finishing operation. Thickness detection may employ a variety of thickness detection methods, such as counting the number of sheets using the sheet sensor Se of the discharge outlet and multiplying the number of sheets by the average thickness of a sheet.

The drive motor M6 drives the movable clamper 421 in a direction approaching the fixed clamper 422 to grip a sheet bundle. When engaged, the gripping sensor Sg turns ON and the drive motor M6 drives a predetermined amount after that signal. This causes the movable clamper 421 to further approach the fixed clamper 422 while overcoming an urging spring to grip the sheet bundle, not shown, and then to stop. The sheet bundle thickness is detected from the output value of the sheet bundle thickness sensor Sa (not shown) and the sheet bundle is securely held. At this time, the rising and lowering motor M7 drives the gripping conveyance means 420 to move in a downward direction of FIG. 1 while gripping the sheet bundle. The adhesive application position X-X is set at this position.

Adhesive Application Unit

The adhesive application unit E is composed of a container 61 for holding adhesive arranged at the adhesive application position X-X; an applicator roll 62 rotatably installed in the container; a drive motor M8 for rotatingly driving the applicator roll 62; and a drive motor M9 for reciprocally driving the container along the sheet bundle.

Figure 4A:
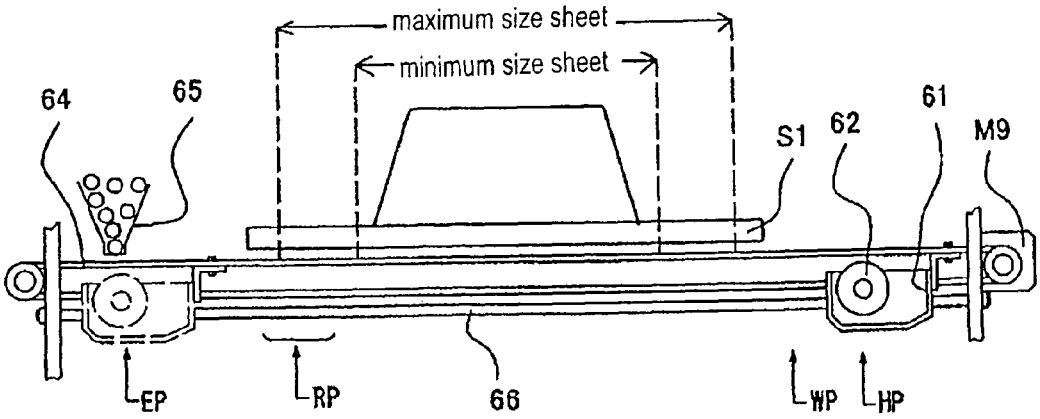

FIG. 4A is a side view of the adhesive application unit E and comprises a container 61 formed to a shorter length (dimension) than the bottom side edge S1 of the sheet bundle S. The container 61 is supported on a guide rail 66 (see FIG. 4A) mounted to the apparatus frame and is configured to move along the bottom side edge S1 of the sheet bundle S1 along with the applicator roll 62 mounted thereto. The container 61, supported by the guide rail 66, is fastened to a timing belt 64 mounted to the apparatus frame along this rail. A drive motor M9 is linked to the belt 64.

Figure 4B:
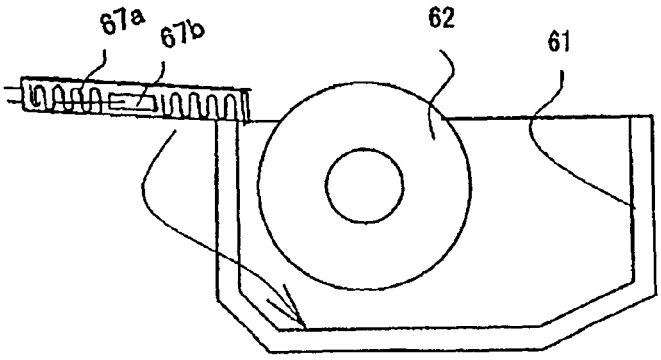

In some embodiments, the container 61 is shorter than the length of the sheet bundle, and is configured to move along the sheets. Non-limiting, it a container 61 may comprise a tray that is larger than the length of the sheet bundle bottom side edge S1 and may only move the applicator roll 62 in left and right directions of FIG. 4A. Thermo-fusion adhesive is stored in the container 61. Heating means 67*a* and temperature control means 67*b* are provided to keep the temperature inside the container 61 at the melting temperature of the adhesive. Heating elements may include, for example, a heater (67*a* in FIG. 4B) and temperature detecting elements 67*b*, such as are embedded in the bottom of the container 61. Power is connected to the heating elements 67*a* and is controlled by CPU360. The value of the applied current is set according to the melting temperature of the adhesive and a temperature value detected by the temperature detection elements 67*b*. The temperature inside the container is configured to always match the melting temperature of the adhesive by comparing them, such as by a comparator.

The melted adhesive then impregnates the applicator roll 62 comprising the adhesive application member. The applicator roll 62 may comprise a porous and heat resistant material and is formed so that when covered with adhesive, the adhesive will form a thick layer on the circumference of the applicator roll.

The container 61 reciprocatingly moves between its home position HP, an idling position WP from where it starts its outward movement along the bottom edge of the sheet bundle S1, a return position RP from where it starts its return movement along the bottom edge of the sheet bundle, and an idling position EP where adhesive is replenished. The movement to each of these positions is accomplished by drive motor M9. The relationships between the positions are set to the positional relationships shown in FIG. 4A. When initializing, such as when the apparatus power is turned ON, the home position HP is set. A sheet gripping signal from the gripping sensor Sg of the gripping conveyance means 420 cause the container to move from the home position to the idling position WP. At the same time as this movement, the drive motor M8 starts rotating the applicator roll 62.

Next, the container 61 begins moving along the guide rail 66 to the left side by rotatingly driving the drive motor M9 with an application instruction signal. In the outward movement (in the left direction of the drawing), the applicator roll 62 touches the sheet bundle and separates the ends of the sheets. In the return movement (in the right direction of FIG. 4A) a gap of a predetermined amount is formed between the sheet edges and adhesive roll 62 is applied by an eccentric cam adjusting the positional relationship of the adhesive roll 62 and the sheet bundle. Then, the drive motor M9 drives to move from one edge of the sheet bundle (right edge in the drawing) to another edge (left edge of the drawing) with size information of the sheets. The return movement is controlled at the return position RP. When the drive motor M9 moves the container 61 from the operating position, where adhesive is applied to the sheet bundle, to the idling position EP separated from the adhesive application position for idling upon receipt/generation of a idling instruction signal, adhesive is replenished to the container from an adhesive tank 65 arranged at the idling position EP.

Inserter Apparatus

A cover sheet is bound to the sheet bundle applied with adhesive at the adhesive application unit E. Sheets formed with images are sequentially conveyed to the discharge outlet 109 of the image printing unit A. Normally, a discharge sheet stacker is prepared at the discharge outlet 109. According to the present invention, however, the sheet conveyance path P1 is linked to the discharge outlet 109 as the bookmaking apparatus B, and an inserter J is installed at sheet conveyance path P1.

The inserter J is composed one or a plurality of stacking trays 201 for stacking sheets (FIG. 1 shows two tiers of stacking trays 201), pickup means 202 for separating sheets on the stacking tray 201 into single sheets, and a sheet feeding path P2 for guiding a sheet from the pickup means 202 to the sheet conveyance path P1.

Sheets set on the stacking tray 201 are fed to the sheet conveyance path P1 between sheets sequentially conveyed from the discharge outlet 109 of the image printing unit A. In other words, after a series of sheets are formed with images and conveyed from the image printing unit A, after the final sheet, sheets are fed from the stacking tray 201. Special sheets such as thick or coated sheets are prepared as cover sheets in the stacking tray 201. A sheet on the stacking tray 201 is conveyed to the sheet conveyance path P1 by a control signal sent from the bookmaking apparatus B. The stacking trays 201 employs a two-tiered approach to make it possible to prepare different types of cover sheets in advance on the trays, allowing the operator to select the type of cover sheet to bind to the sheet bundle.

The sheet conveyed from the image forming apparatus is conveyed toward the stacking tray unit C, described below, for the bookmaking process. The inserter J supplies the cover sheet to this discharge path. For that reason, inserter J comprises a hopper for feeding cover sheets, separating means for separating sheets from the hopper into single sheets, and a conveyance mechanism for conveying a sheet to the discharge path. Note that no particular configuration is used in the embodiment shown in the drawings, and that any known inserter mechanism may be employed and still be within the spirit of the present invention.

Cover Sheet Conveyance Unit

In the system shown in FIG. 1, the sheet feeding path P2 of the inserter J is linked, and the discharge path P3 of the stacking tray unit C is connected, to the sheet conveyance path P1. A cover sheet conveyance path P4 is linked to the sheet conveyance path P1 via a path switching piece 300, and a cover sheet from the inserter J is guided to the cover sheet conveyance path P4. This cover sheet conveyance path P4 orthogonally intersects a bookmaking path P5 to join a sheet bundle from the bookmaking path P5 and a cover sheet from the cover sheet conveyance path P4 at a substantially T-shape.

This cover sheet conveyance path P4 is composed by upper conveyance guides 63*a* and 63*b* and a lower conveyance guide 63*c*, the upper conveyance guides 63*a* and 63*b* separated from the lower conveyance guide 63*c* by a predetermined gap. The upper conveyance guides 63*a* and 63*b* are separated into a first upper conveyance guide 63*a* on the right side, and a second upper conveyance guide 63*b* using the bookmaking path P5 as a boundary, and the right and left conveyance guides individually open and close. A binding position 150 is formed as an intersecting space at an intersection of the bookmaking path P5 and the cover sheet conveyance path P4 and the sheet bundle and cover sheet are jointed into a substantial upside-down T-shape at this position.

Registration means for positioning the cover sheet at each position of the conveyance direction and the conveyance right angle direction and cover sheet conveyance means for conveying a cover sheet positioned by the registration means at the binding position 150 are arranged on the cover sheet conveyance path P4. First, the cover sheet conveyance means is composed of conveyance rollers 69 arranged on the cover sheet conveyance path P4, driver roller 69 mounted on the lower conveyance guide 63*c*, and follower roller 69*a* mounted on the upper conveyance guides 63*a*. A drive motor, not shown, is linked to the drive roller 69. The upper conveyance guide 63*a* and the follower roller 69*a* are mounted to the apparatus frame by a cam lever, for example, that is capable of moving between a position that touches the driver roller 69 and a separated position rising thereabove. Therefore, the upper conveyance guide 63*a* and the follower roller 69*a* are configured to move between an operating position, where they touch a cover sheet in the path, moving the cover sheet to the left side of FIG. 2, and a retracted position that rises separated from the cover sheet.

Figure 5:
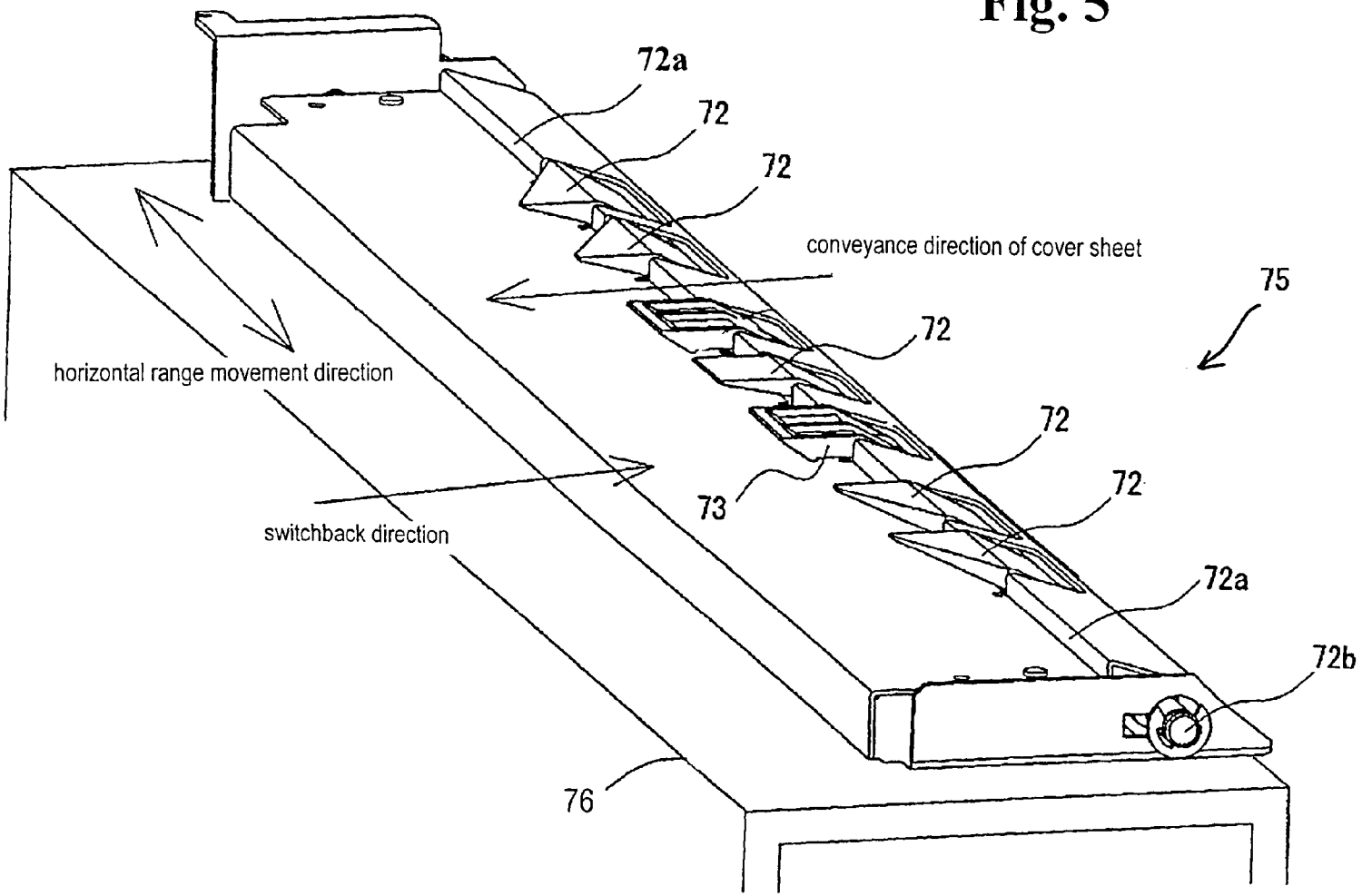
FIG. 5 is a perspective view of an aligning unit comprising the cover sheet conveyance path according to the apparatus of FIG. 1.

In addition, an aligning unit 75, shown in FIG. 5, is provided in this path. The aligning unit 75 is composed of steps 72*a* and nipping claw members 72 that nip a cover sheet, and have a positional relationship in the drawing with the conveyance direction of the cover sheet (the arrow in the drawing). An upper paper guide (not shown) is fixedly mounted. The aligning guide 75 is mounted so as to be able to move in the left and right directions (a horizontal range movement in the drawing) in the drawing on the fixed frame 76.

In other words, a guide rail, not shown, is provided on the fixed frame 76 and the aligning unit 75 is movably mated to this rail. A stepping motor, capable of both forward and reverse drives, is provided on the fixed frame 76 and is linked to the aligning unit 75. Therefore, by driving this drive motor, the aligning unit 75 moves in the left and right directions of the drawing.

As shown in FIG. 5, there is a plurality of nipping claw members 72 that are configured to rotate by a shaft 72*b*. At the position shown in the FIG. 5, they nip and hold a cover sheet. When the shaft 72*b* rotates in the clockwise direction of the drawing, the nipping claw members 72 stand upright and engage a sheet edge along with a step wall 72*a*. Drive means, such as an operating solenoid (not shown), are linked to the shaft 72*b*. The nipping claw members 72 are arranged at the sheet conveyance path and when the operating solenoid is off, they are placed in a laid-over posture to guide a cover sheet to the cover sheet conveyance path. Thereafter, when the operating solenoid turns on, the nipping claw members 72 shift to an upright posture to engage and stop a cover sheet that is switched back and fed in reverse.

A reverse rotating roller 68 is provided at a downstream side of the aligning unit 75 on the cover sheet conveyance path P4. The roller 68, mounted on a swingable support arm, is arranged to rise and lower between a position to engage the cover sheet and a retracted position where it does not engage the cover sheet. A drive motor is linked to the roller 68 to feed the cover sheet in a direction opposite to the feed direction.

As shown in FIG. 2, at least one set of conveyance roller 69 and follower roller 69*a* is arranged on the cover sheet conveyance path P4. A conveyance roller (inlet roller) 70 is arranged at an upstream side of the aligning unit 75. This conveyance roller 69 composes the cover sheet conveyance means, described below, and conveys a sheet aligned by the aligning unit 75 a predetermined amount.

To describe that structure together with its operation, a sensor Si detects the leading edge of the cover sheet advancing into the cover sheet conveyance path P4 and the cover sheet is conveyed by the conveyance roller 70 and conveyance roller 69. At this point, the nipping claw members 72 of the aligning unit 75 are laid over to allow the cover sheet to proceed through, and the reverse rotating roller 68 is set retracted upward from the path. After a delay time allowing the leading edge of the sheet to pass the aligning unit 75, upon receipt of the signal of the sensor Si, the conveyance roller 70 and conveyance roller 69 retract from the sheet. The reverse rotating roller 68 is lowered then to a position where it engages the sheet, and at the same time, all conveyance rollers that are engaging the sheet retract upward away from the sheet. Then, the reverse rotation roller 68 drives to move the sheet in a direct opposite to the conveyance direction. At this time, the nipping claw members 72 are stood upright by the operating solenoid. When this occurs, the trailing edge of the sheet abuts the nipping claw members 72 and immediately thereafter, the reverse rotating roller 68 stops and separates from the sheet at the same time. Note that the timing to stop the reverse rotating roller 68 is calculated from a signal that the sensor Si has detected the trailing edge of the sheet.

Power to the operating solenoid is then cut and the nipping claw members 72 return to their original state and the trailing edge of the sheet is nipped by the stepped portion (plates) of the aligning unit 75 and the nipping claw members 72. In this state, when the aligning unit 75 moves in a direction that is orthogonal to the conveyance direction, the sheet nipped by the nipping claw members 72 moves at the same time.

A plurality of sensors is arranged in a direction orthogonal to the direction of sheet conveyance on the fixed frame 76 that movable supports the aligning unit 75. These sensors determine the position of the horizontal direction of the sheet. After determining (aligning) the position of the orthogonal direction of sheet conveyance, the conveyance rollers 69 and 70 are positioned where they engage the sheet and the reverse rotating roller 68 is set at a position retracted from the sheet. Then, the operating solenoid turns on again, rotating the nipping claw members 72 to an upright position, and then the conveyance roller 69 drivingly rotates. When this occurs, the sheet is conveyed to a downstream side of the cover sheet conveyance path P4, and the nipping claw members 72 recover to their initial, laid-over posture.

The conveyance roller 69 thus configured is linked to the drive motor 10, and is controlled by a control CPU 360. An aligning operation for aligning a cover sheet positioned by the nipping claw members 72 in a direction that is orthogonal to the conveyance direction, and then the conveyance rollers 69 convey the cover sheet a predetermined amount toward the binding position 150. The control CPU 360 calculates the conveyance amount to match the center of the sheet to the binding position center from the size of the cover sheet (in the conveyance direction), and the thickness of the sheet bundle conveyed from the bookmaking path P5 to control the conveyance roller 69, and based on those results it determines the number of steps of the drive motor composed of a stepping motor to supply drive pulses. The method by which the conveyance amount is calculated is selectable and may be done using only the sheet length, or may be calculated using the sheet length and sheet bundle thickness determined by the sheet thickness detection sensor Sa.

In this way, the cover sheet is conveyed to the binding position 150 to a set predetermined position that is the intersecting point of the cover sheet conveyance path P4 and the bookmaking path P5. The upper conveyance guide 63*b* of the binding position 150 is composed of an opening and closing guide plate and are configured to move between a position for covering the path and guiding the top of the cover sheet, and a position retracted from the bookmaking path P5. Then, after the conveyance guide 63*b* guides the cover sheet, as shown in FIG. 2, it retracts to open the bookmaking path P5. The structure includes a cam lever attached to the apparatus frame. The conveyance guide 63*b* is fastened to this lever, and the structure can employ suitable structure such as swinging the lever using drive means such as a solenoid or motor.

Binding Unit

The binding position is formed at an intersecting point of the bookmaking path P5 and the cover sheet conveyance path P4, and at this position a joining means and a back folding block 155 is provided that configures the backup member 151. At this position, the sheet bundle conveyed from the bookmaking path P5 and the cover sheet conveyed from the cover sheet conveyance path are joined in an upside-down T shape. Adhesive is first applied by the adhesive application unit E to the lower side edge of the sheet bundle gripped by the gripping conveyance means 420 at the bookmaking path P5. At the same time as this, the cover sheet is set at the binding position 150 at the cover sheet conveyance path P4.

The sheet bundle is supported by the gripping conveyance means 420 and fed to the binding position. At that time, the cover sheet is supported by the backup member 151 and the two are joined. In this state, the back-folding blocks 155 composed of a pair of blocks, left and right, move from positions separated from each other to press the backside of the sheet bundle, and together with the backup member 151 press from the backside in the bookmaking process. Folding rollers 160 are provided on the bookmaking path P5 at a downstream side of the binding position 150, and are configured to contact and separate from each other. They contact each other by a pressure spring, and are separated by the operating solenoid. The folding rollers 160 are then separated to allow the sheet bundle joined to the cover sheet to be lowered to a downstream side along the bookmaking path P5 by the gripping conveyance means 420. A sensor detects the position of the sheet bundle and causes the folding rollers 160 to press together.

The clampers 421 and 422 then release the sheet bundle, and rotate the folding rollers 160 in the conveyance direction to convey the sheet bundle out of the binding unit. Upon being conveyed out, the sheet bundle and cover sheet are joined together into a booklet and are folded.

Cutting Unit

The booklet sheet bundle is fed by the folding rollers 160 (FIG. 2) to the cutting unit arranged at a downstream side of the binding position 150, and the edges of the sheets are cut to be aligned. FIG. 1 illustrates a rotating table 170 provided at the bookmaking path P5 downstream of the folding rollers 160 to grip and fold the sheet bundle. A cutting blade 171 and a blade rest block 172 are prepared downstream of the rotating table. A cutting motor 173 is linked to the cutting blade 171. Sheet cutting edge press member 174 pressingly holds the cutting edges of the sheet. The sheet bundle fed to the bookmaking path P5 is grippingly held by the rotating table and is fed to the cutting position. At the cutting position, the sheet bundle is cut by the cutting blade 171 while being held by the cutting edge press member 174. In this way the sheet bundle, bound at the backside with a cover sheet, is cut at the top, sides and lower edge in order, and is then stored in the storage stacker 180 by the discharge rollers 175.

Figure 6:
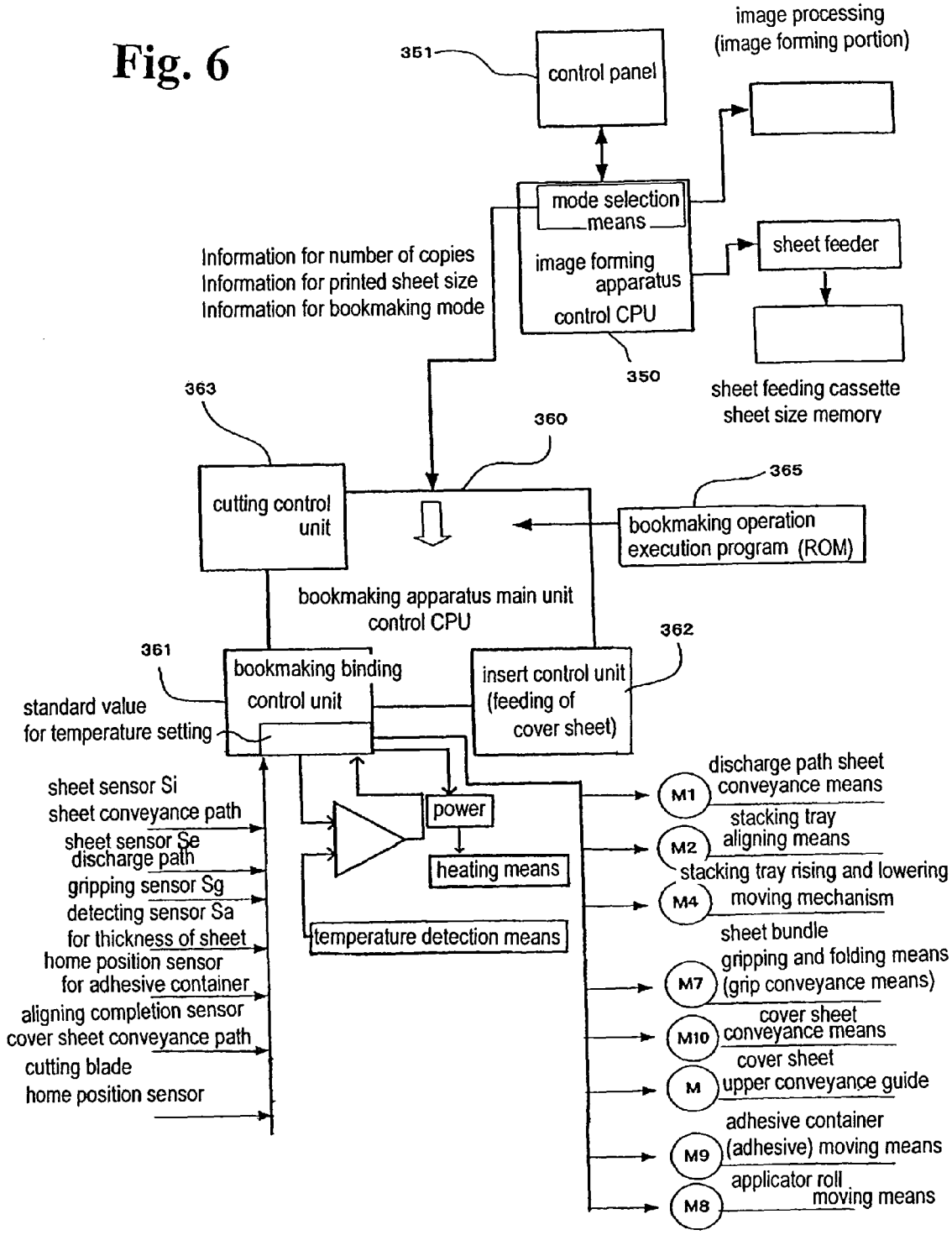
FIG. 6 is a block diagram of one embodiment of the control unit according to the apparatus of FIG. 1.
Figure 7A:
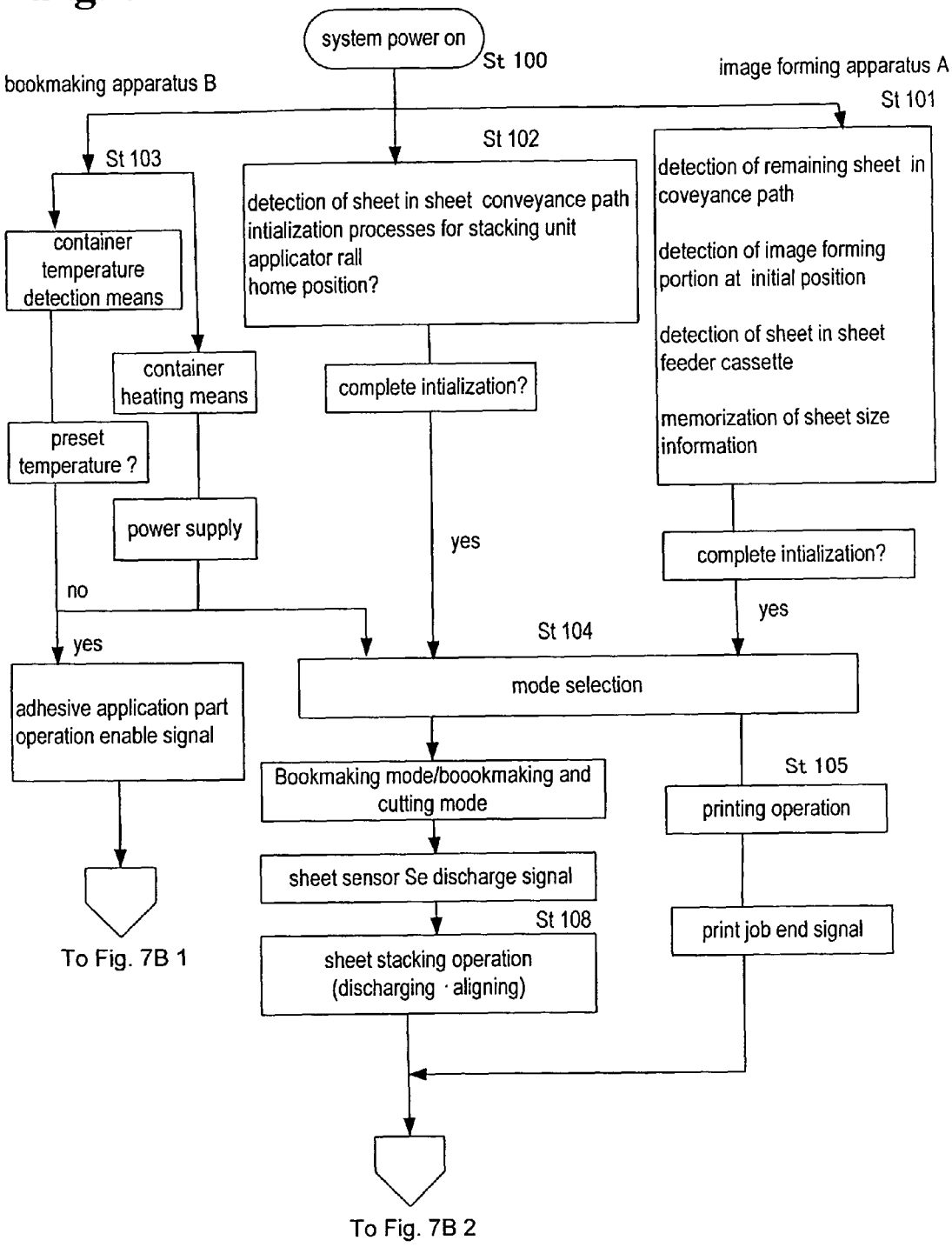
FIGS. 7A and 7B are flowcharts of one embodiment of a bookmaking operation according to the bookmaking apparatus of FIG. 6.
Figure 7B:
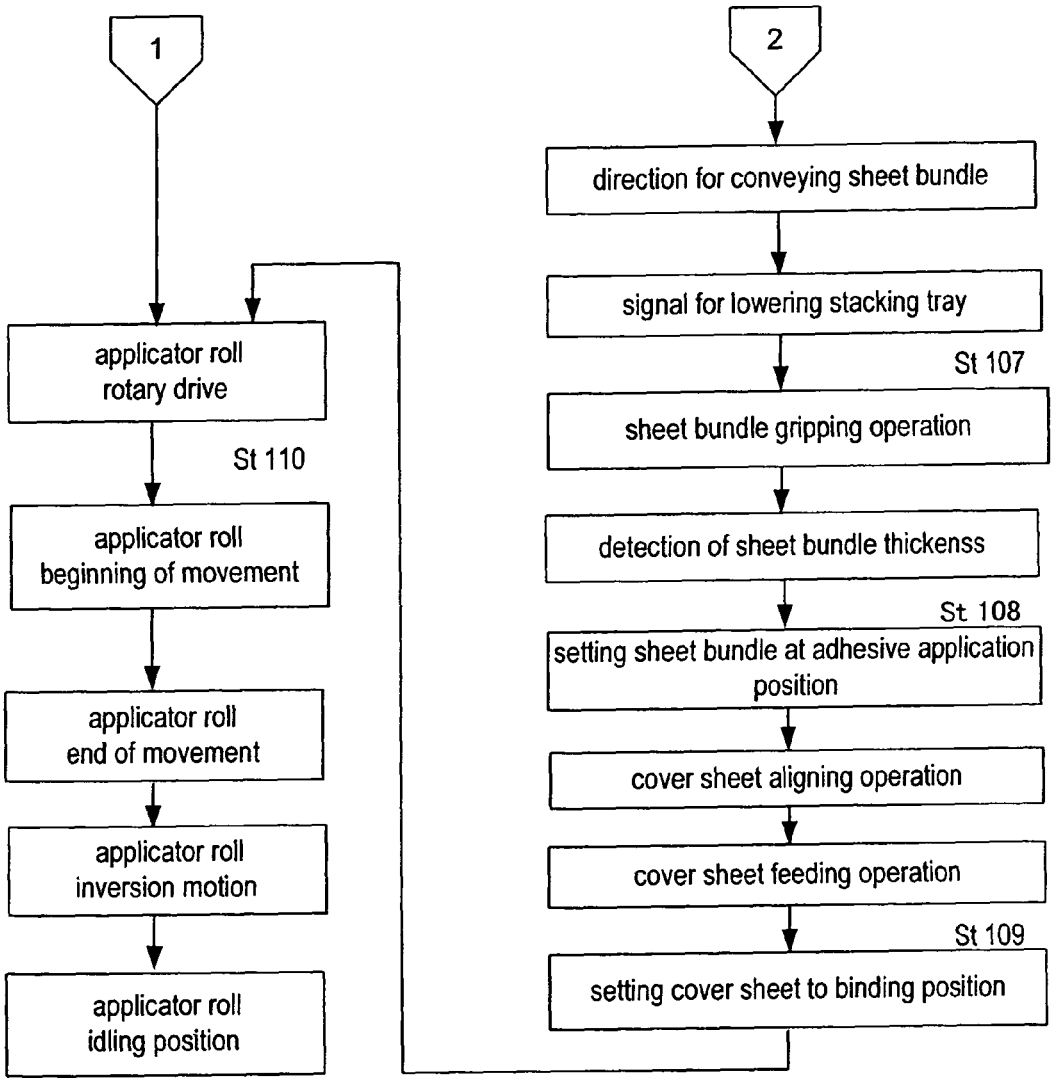

FIG. 6 is a block diagram showing the control of the system apparatus of FIG. 1. FIGS. 7A and 7B are flowcharts of the execution program of the bookmaking operation. As shown in FIG. 6, a system that links the image forming apparatus A and the bookmaking apparatus B may include a control panel 351 and mode selection means provided on the image forming apparatus A. The control CPU 350 of the image forming apparatus A inputs the process selection of "printing process mode," "bookmaking process mode," and "bookmaking and cutting process mode" from the control panel 351.

With the printing process mode, the path switching piece 300 conveys a printed sheet conveyed from the sheet conveyance path P1 to the finishing apparatus 502 from the cover sheet conveyance path P4 and the discharge path P6 and stores it in the stacker provided on the finishing apparatus. Therefore, the printed sheet passes through the bookmaking apparatus.

When the bookmaking process mode is selected, the bookmaking apparatus B guides the printed sheet from the sheet conveyance path P1 to the discharge path P3, and stores the sheet in the storing stacker 180. After collecting all the sheets, the bookmaking apparatus B applies adhesive and binds the sheet bundle to a cover sheet.

When the bookmaking cutting mode is selected, the sheet bundle bound with the cover sheet is cut on the top, sides and lower edge by the cutting blade 171. The backside which is the bound portion is not cut. The sheet bundle is then stacked in the storing stacker 180.

When the bookmaking mode, or the bookmaking cutting mode is selected, the control CPU 350 of the image forming apparatus A transmits a bookmaking mode instruction signal (bookmaking and cutting) and printed sheet size information, at the same time, to the bookmaking apparatus B. At the same time as this, information regarding the number of copies, e.g., when printing n pages and when the final nth page is ended, a job end signal is transmitted to a control CPU 360 comprising part of the bookmaking apparatus.

The control CPU 360 includes bookmaking binding control unit 361, inserter control unit 362, and cutting control unit 363. A conveyance roller drive motor of the sheet conveyance path P1, a drive motor M1 of the discharge path P3 discharge roller 302, a drive motor M2 of the aligning roller 305, and a drive motor M3 of the sheet guide 306 or a drive circuit of the drive solenoid are linked to the bookmaking binding control unit 361.

Linked in a similar manner is a rising and lowering drive motor M4 of the stacking tray 303, a turning motor M5 of the gripping conveyance means, a drive motor M6 of the main clampers 121 that grip the sheet bundle, and a drive circuit of the rising and lowering motor M7 that sends the sheet bundle to the adhesive application position.

Furthermore, a drive motor M8 that rotates the applicator roll 68 that applies adhesive, and a drive circuit of the drive motor M9 that moves the applicator roll 62 along the sheet bundle are connected. The drive motor of the conveyance roller 69 that comprises the cover sheet conveyance means, the drive motor of the reverse rotation roller 68 and the stepping motor that shifts the aligning claw members 72 of the aligning unit 75 in an orthogonal direction of conveyance, are linked to the control CPU 360.

The detection sensors provided on each of the moving members, i.e., sheet sensor Si of the sheet conveyance path P1, sheet sensor Se of the discharge outlet, and the grip sensor, are connected and transmit signals to the control CPU 360.

At room temperature, adhesive is in solid form (a solid object). If the adhesive remaining in the container when starting up the bookmaking apparatus B is solidified, it takes time to melt the adhesive. Therefore, because adhesive is melted and liquefied for use prior to applying it to sheets, the adhesive in the container when starting up the machine is either a solid or a in a gel form. Therefore, when starting up the machine, the apparatus must be left without being operated until the adhesive in the container 61 is completely melted and has reached the set temperature. The control CPU 360 executes the operations shown in FIG. 7, which may be part of a bookmaking operation execution program retrieved from a ROM 365 to warm up the apparatus.

When the power to the apparatus is turned on (St100), the image forming apparatus A and bookmaking apparatus B perform preset initialization operations. For example, with the image forming apparatus A, a sensor provided in each path detects whether a sheet remains in the sheet conveyance paths (conveyance path, discharge path, or recirculation path). If a sheet remains, the operator is prompted to remove the jammed sheet by a jam removal signal. Position sensors detect whether the print head of the image forming unit and other operating means are set at their initial positions, detects the size of the print sheets stored in the sheet feeder cassette 102, and stores this information in memory. A detection method is applied to determine whether the initialization operation has been executed and that the apparatus is in a normal state (St101).

The bookmaking apparatus includes jam sensors arranged at each path to detect whether a sheet or sheet bundle is left in any of the paths P1, P2, P3, P4, P5 and P6. If there is a sheet or sheet bundle present, the operator is prompted with a warning to remove them. Also, status checks for whether the operating means such as a sheet bundle collector, gripping conveyance means, adhesive application means, binding means and cutting means are operating normally are conducted. (St102)

At the same time as these initialization processes, the control CPU360 of the bookmaking apparatus compares the preset temperature with the value detected by the temperature detection means 67*b*, to determine whether the adhesive in the container 61 has reached a predetermined melting temperature. If it has not reached a predetermined temperature, power is supplied to the heating means 67*a* to raise the temperature of the container (St103). Even if the temperature in the container has not reached the predetermined temperature, an apparatus ready signal may be generated on the image forming apparatus A allowing it to receive a mode selection from the control panel equipped on the image forming apparatus A.

If the "bookmaking mode" or the "bookmaking and cutting mode" is selected on the image forming apparatus (St104), the image forming apparatus A prints a sheet, and discharges it from the discharge outlet 109 (St105). The bookbinding apparatus B guides printed sheets from the sheet conveyance path P1 to the discharge path P3, and conveys them from the discharge outlet 301 to the stacking tray 303. When this happens, the aligning roller 305 described above, the paper guide 306 and aligning means, not shown, align and stack sheets on the tray. (St106) This stacking process is repeated until a print job end signal is transmitted from the image forming apparatus A, causing the control CPU 360 to lower the stacking tray 303 a predetermined amount at which point the sheet bundle on the tray is transferred to, and gripped by, the gripping conveyance means 420 (St107).

The gripping conveyance means turns the sheet bundle from a horizontal posture to a vertical posture and conveys and sets the sheet bundle at the adhesive application position X-X. (St108)

The gripping conveyance means 420 detects the thickness of the sheet bundle with the sheet bundle thickness sensor Sa by the gripping action of the sheet bundle. Next, the control CPU 360 conveys and sets the cover sheet from the cover sheet conveyance path P4 to the binding position (St109).

The control CPU 360 then moves the applicator roll 62 from the home position HP to the idling position WP when the adhesive container temperature reaches the predetermined temperature. While driving the drive motor M8, the drive motor M9 moves applicator roll 62 from the right edge of FIG. 4A to the left edge (St110).

With the control of the drive motor M9, the applicator roll 62 applies adhesive to the bottom edge of the sheet bundle. Then, the control CPU 360 drives the rising and lowering motor M7 of the gripping conveyance means 420 to move the sheet bundle downstream of the bookmaking path P5. At this time, the cover sheet is set at the cover sheet conveyance path P4 at the binding position 150 on the downstream side of the adhesive application position, where the cover sheet and sheet bundle are joined in an upside-down T shape. At this time, the backup member 151 supports the backside of the cover sheet at the binding position 150.

Next, when the control CPU 360 moves the left and right pair of folding blocks 155 from a position where they are separated in FIG. 2 to a position where the are nipping the cover sheet, the sheet bundle and cover sheet are pressed at the backside and formed into a booklet. After this, the control CPU 360 moves the backup member 151 and folding blocks 155 away from the bookmaking path P5. the sheet bundle is then handed over to the folding rollers 160 downstream by the gripping conveyance means 420.

The operations of cutting the sheet bundle and storing it are then executed as explained in the section entitled "Cutting Unit." If the temperature of the adhesive has not reached its preset temperature, the control CPU 360 holds the sheet bundle at the adhesive application position X-X, and causes the apparatus to wait while the cover sheet is set at the binding position 150, waiting for the adhesive temperature to reach its setting.

Furthermore, the control CPU 360 returns the stacking tray 303 to the stacking position after transferring the sheet bundle from the stacking tray 303 to the gripping conveyance means 420, and then sequentially stacks subsequent sheets conveyed from the discharge path. In this way, it is possible to efficiently process sheet bundles when starting up the apparatus by sequentially forming images on the image forming apparatus A, stacking sheets in the stacking tray 303, transferring sheets with the gripping conveyance means 420, and conveying and setting a cover sheet at the binding position, without having to wait for the container storing the adhesive to reach the set temperature.

The disclosure of Japanese Patent Application No. 2005-265935 filed on Sep. 13, 2005 is incorporated herein by reference.

While the invention has been explained with reference to the specific embodiments of the invention, the explanation is illustrative and the invention is limited only by the appended claims.

What is claimed is:

1. A bookmaking apparatus comprising:

a sheet conveyance path configured to sequentially convey printed sheets;

sheet conveyance means arranged on the sheet conveyance path for sequentially conveying the sheets;

stacking tray means for stacking the sheets from the sheet conveyance means to provide a sheet bundle;

sheet holding means for holding the sheet bundle from the stacking tray means at a predetermined adhesive application position; and adhesive application means for applying adhesive to the sheet bundle held by the sheet holding means;

wherein the adhesive application means comprises a container including heating means for melting thermo-fusion type adhesive, an applicator member arranged in the container for applying adhesive to an edge of the sheet bundle, and temperature control means for maintaining the adhesive in the container at a predetermined temperature with the heating means;

wherein the temperature control means controls the heating means which heats the adhesive in the container to a predetermined melting temperature when power is supplied to the apparatus; and wherein the sheet conveyance means includes a control unit for conveying and stacking the sheets sequentially from the sheet conveyance path to the stacking tray means while the temperature control means melts the adhesive, and the sheet holding means is controlled to convey the stacked sheet bundle from the stacking tray means and to hold the stacked sheet bundle at a predetermined adhesive application position while the temperature control means controls the heating means to simultaneously warm-up and melt the adhesive in the container following power being supplied to the apparatus with the adhesive in a non-fused state.

2. The bookmaking apparatus according to claim 1, wherein the control unit of the sheet conveyance means controls a subsequent sheet to be conveyed out from the sheet conveyance means to the stacking tray means after the sheet holding means conveyed and held the sheet bundle at the predetermined adhesive application position while the temperature control means controls the heating means to melt the adhesive in the container while power is supplied to the apparatus.

3. The bookmaking apparatus according to claim 1, further comprising:

a cover sheet conveyance path configured at a downstream side of the adhesive application position; and cover sheet conveyance means arranged in the conveyance path to convey a cover sheet from a predetermined conveyance position, the cover sheet conveyance means operable to convey and set the cover sheet to a predetermined position while the temperature control means controls the heating means to melt adhesive in the container while power is being supplied to the apparatus.

4. An image forming system comprising:

an image forming apparatus configured to form an image on a sheet; and a bookmaking apparatus according to claim 1, said sheets with the image formed by the image forming apparatus being bundled together.

5. The bookmaking apparatus according to claim 1, wherein the sheet conveyance means include a motor for rotating the sheet bundle from a substantially horizontal position to a vertical position before conveying the sheet bundle to the predetermined adhesive application position.

6. The bookmaking apparatus according to claim 1, wherein the container is operatively connected with a container motivating motor which moves the container reciprocatingly between a home position, a first idling position from where the container starts a predetermined outward movement along a bottom edge of the stacked sheets, a return position from which it starts a return movement along the bottom edge of the stacked sheets, and a second idling position where adhesive is replenished.

7. A bookmaking apparatus comprising:

a sheet conveyance path configured to sequentially convey printed sheets;

sheet conveyance means arranged on the sheet conveyance path for sequentially conveying the sheets;

stacking tray means for stacking the sheets from the sheet conveyance means to provide a sheet bundle;

sheet holding means for holding the sheet bundle from the stacking tray means at a predetermined adhesive application position;

adhesive application means for applying adhesive to the sheet bundle held by the sheet holding means;

a cover sheet conveyance path configured at a downstream side of the adhesive application position; and cover sheet conveyance means arranged in the conveyance path to convey a cover sheet from a predetermined conveyance position to a predetermined binding position to bind the cover sheet and the sheet bundle held by the sheet holding means, wherein the adhesive application means comprises a container including heating means for melting thermo-fusion type adhesive, an applicator member arranged in the container for applying adhesive to an edge of the sheet bundle, and temperature control means for maintaining the adhesive in the container at a predetermined temperature with the heating means, the temperature control means controls the heating means which heats the adhesive in the container to a predetermined melting temperature when power is supplied to the apparatus, and the bookmaking apparatus further comprises a control unit for controlling the sheet conveyance means and the cover sheet conveyance means so as to convey and stack the sheets sequentially from the sheet conveyance path to the stacking tray means, and set the cover sheet to the predetermined binding position during a period wherein the temperature control means warms-up and melts the adhesive.

8. An image forming system comprising:

an image forming apparatus configured to form an image on a sheet; and a bookmaking apparatus according to claim 7, said sheets with the image formed by the image forming apparatus being bundled together.

* * * * *